United States Patent [19]

McKinney

[11] Patent Number: 4,631,026

[45] Date of Patent: Dec. 23, 1986

[54] ROTARY TURNTABLE FURNACE FOR LITHARGE PRODUCTION

[75] Inventor: Benjamin F. McKinney, Indianapolis, Ind.

[73] Assignee: Oxide & Chemical Corporation, Indianapolis, Ind.

[21] Appl. No.: 796,236

[22] Filed: Nov. 8, 1985

[51] Int. Cl.[4] ..... F27B 9/16

[52] U.S. Cl. ..... 432/138; 432/139; 432/239; 414/158

[58] Field of Search ..... 432/138, 139, 239; 202/103; 414/158

[56] References Cited

U.S. PATENT DOCUMENTS

| | | | |
|---|---|---|---|
| 255,970 | 4/1882 | Gregg | 432/138 |
| 1,064,516 | 6/1913 | Miller | 414/187 |
| 1,208,248 | 12/1916 | Wedge | 414/196 |
| 1,993,688 | 3/1935 | Specketer et al. | 432/138 |
| 3,452,972 | 7/1969 | Beggs | 432/138 |
| 3,763,013 | 10/1973 | Allred | 202/103 |
| 4,412,813 | 11/1983 | Wulf | 432/11 |
| 4,449,924 | 4/1984 | Ceretti | 432/138 |

*Primary Examiner*—Henry C. Yuen

*Attorney, Agent, or Firm*—Woodard, Weikart, Emhardt & Naughton

[57] ABSTRACT

A turntable furnace for heating particulate material and which is particularly suited for the industrial production of litharge. The particulate material is heated inside the furnace on a turntable hearth and distributed radially outwardly from the center of the hearth to a discharge opening by a pair of water cooled screw augers. The rotational speed of the turntable hearth and the screw augers may be independently controlled to vary the amount of mixing and blending of the particulate material and to vary the length of time the particulate material is subjected to heat.

7 Claims, 3 Drawing Figures

ROTARY TURNTABLE FURNACE FOR LITHARGE PRODUCTION

BACKGROUND OF THE INVENTION

The present invention relates generally to the field of industrial devices which are useful for heating particulate material and, more particularly, to such devices which are useful in the production of litharge.

Litharge (lead monoxide) is supplied in industrial quantities for use in the pigment industry and in the leaded glass industry. Litharge is produced by oxidation of particulate lead into lead monoxide. Presently, there are two methods employed in the production of litharge. The first method uses a rake furnace to oxidize lead in a batch process. The lead or "leady oxide" (PbO+Pb) is heated and stirred by means of a rotating rake. The second method is a continuous production process which employs a horizontal drying kiln in which the lead is tumbled while being oxidized.

Both the methods described above suffer certain disadvantages in use in that the particulate material does not get evenly heated, resulting in the undesired presence of lead and "red lead" in the final product. Moreover, in certain applications, such as the leaded glass industry, it is important that the litharge meet certain particle size distribution specifications. Since the input raw material does not meet such specifications, the final litharge product must be milled to meet the desired particle size specifications. While the mixing and blending action which takes place using the above described methods does serve to somewhat reduce the particle size distribution, considerable milling operations are still required.

Each of the following references disclose various types of rotary furnaces for heating particulate material: U.S. Pat. No. 3,763,013 to Allred; U.S. Pat. No. 4,412,813 to Wulf; U.S. Pat. No. 4,449,924 to Ceretti; U.S. Pat. No. 1,208,248 to Wedge; and U.S. Pat. No. 1,064,516 to Miller. None of these references, however, disclose the use of rotating helical conveyors in a rotary furnace.

SUMMARY OF THE INVENTION

One embodiment of the present invention comprises a furnace having top and side refractory walls defining a furnace chamber. At least one of the refractory walls defines a feed inlet for feeding particulate matter into the chamber, a discharge outlet for discharging the particulate material outside the chamber, and a burner inlet communicating inside the chamber. A heating means is also provided associated with the burner inlet for heating the particulate matter within the chamber. There is further provided a turntable hearth rotatably disposed in the chamber on a first axis of rotation, a first drive means for rotatably driving the hearth, a distributing means, including at least one screw auger, for distributing the contents of the chamber in a direction radially outwardly from the axis of rotation of the hearth by screw movement, and a second drive means for driving the distributing means.

It is an object of the present invention to provide an improved furnace for heating particulate material.

It is a further object of the present invention to provide a furnace of improved design which is particularly useful for the industrial production of litharge.

It is a yet further object of the present invention to provide an improved furnace for litharge production which allows for higher production volume rates, greater uniformity in chemical and physical characteristics of the litharge product, and requires less milling of the product to attain the desired particle size than previous techniques.

DESCRIPTION OF THE PREFERRED EMBODIMENT

Figure 1:
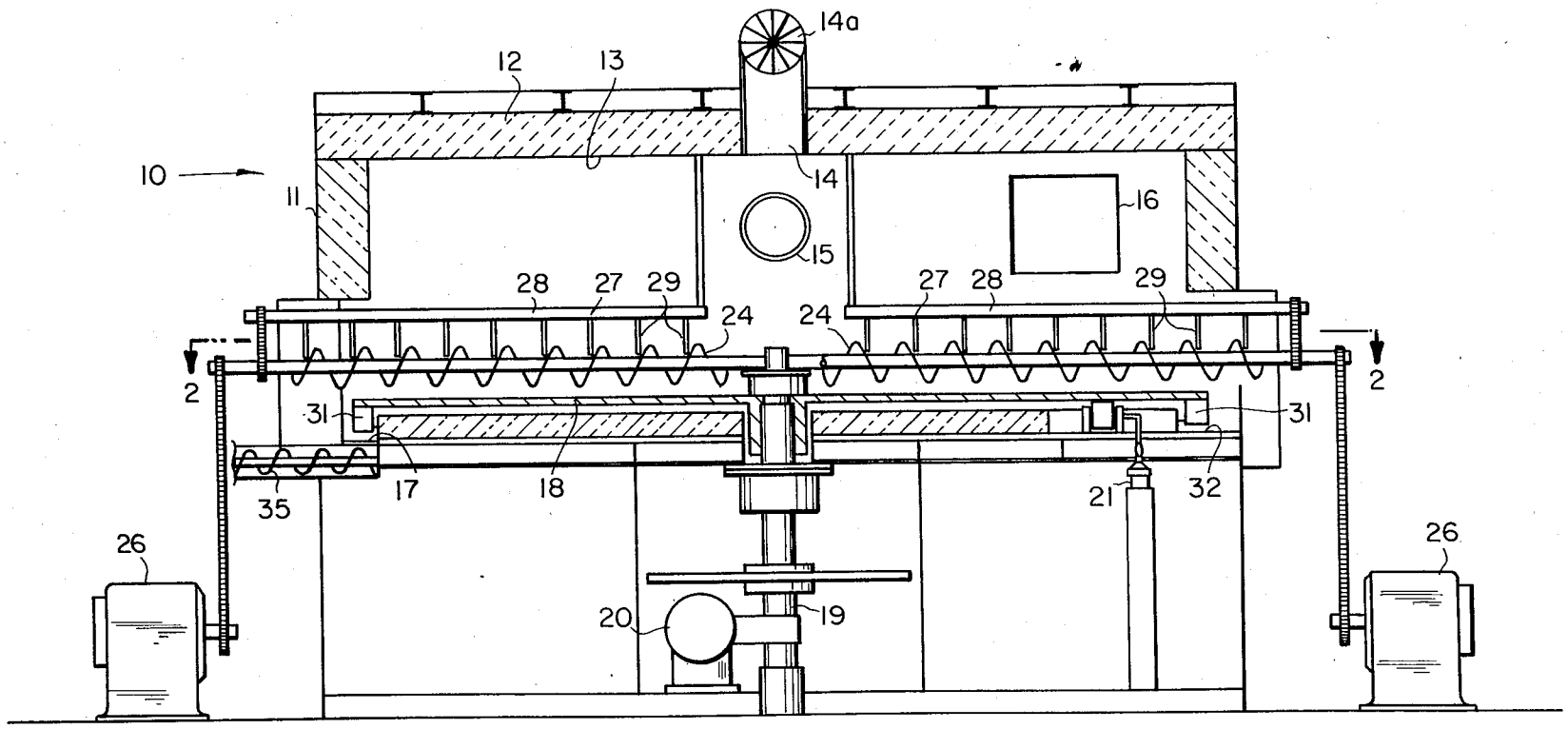
FIG. 1 is a vertical cross section view of the furnace of the present invention taken along line 1—1 in FIG. 2.
Figure 2:
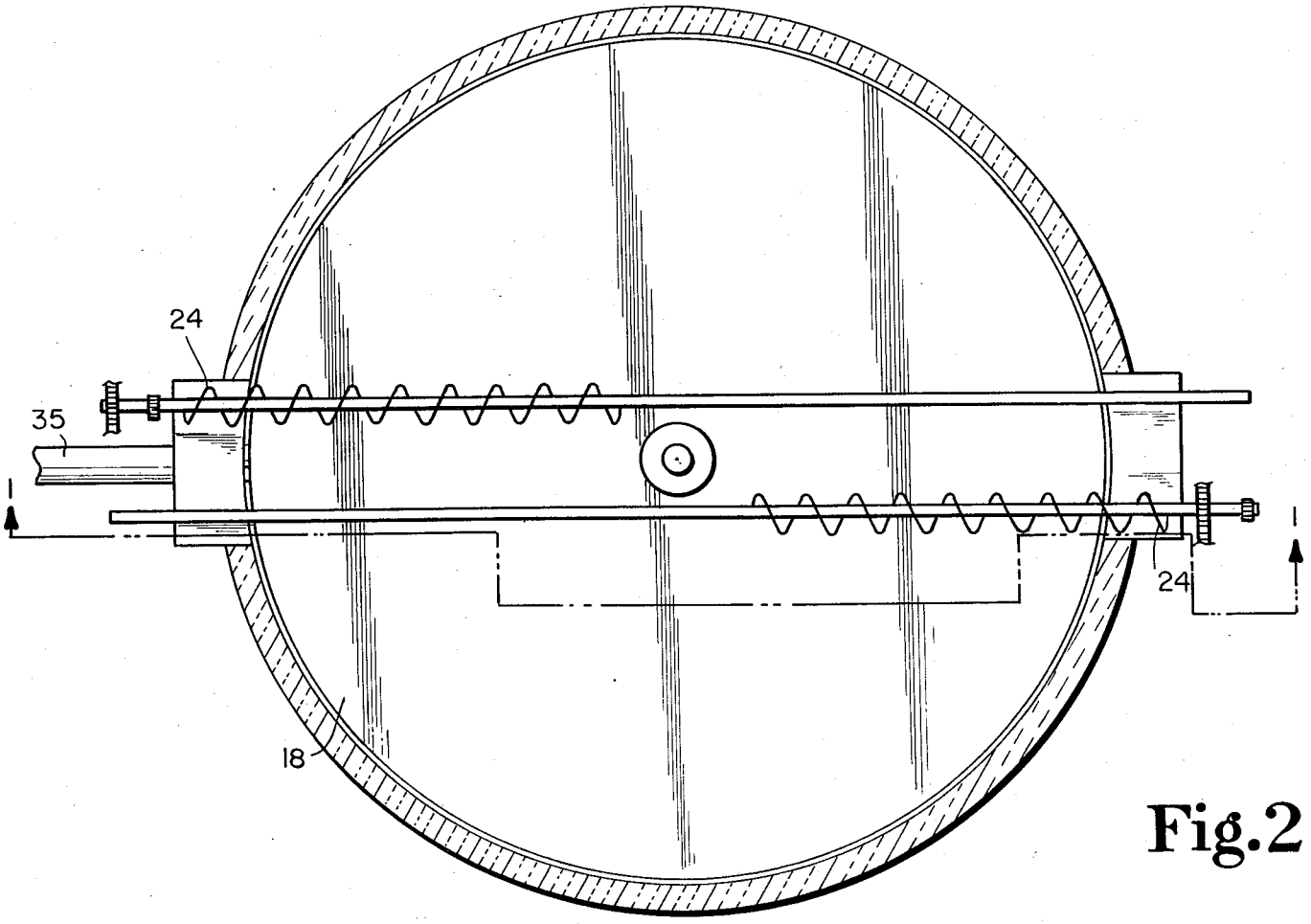
FIG. 2 is a horizontal cross section view of the furnace taken along line 2—2 in FIG. 1.
Figure 3:
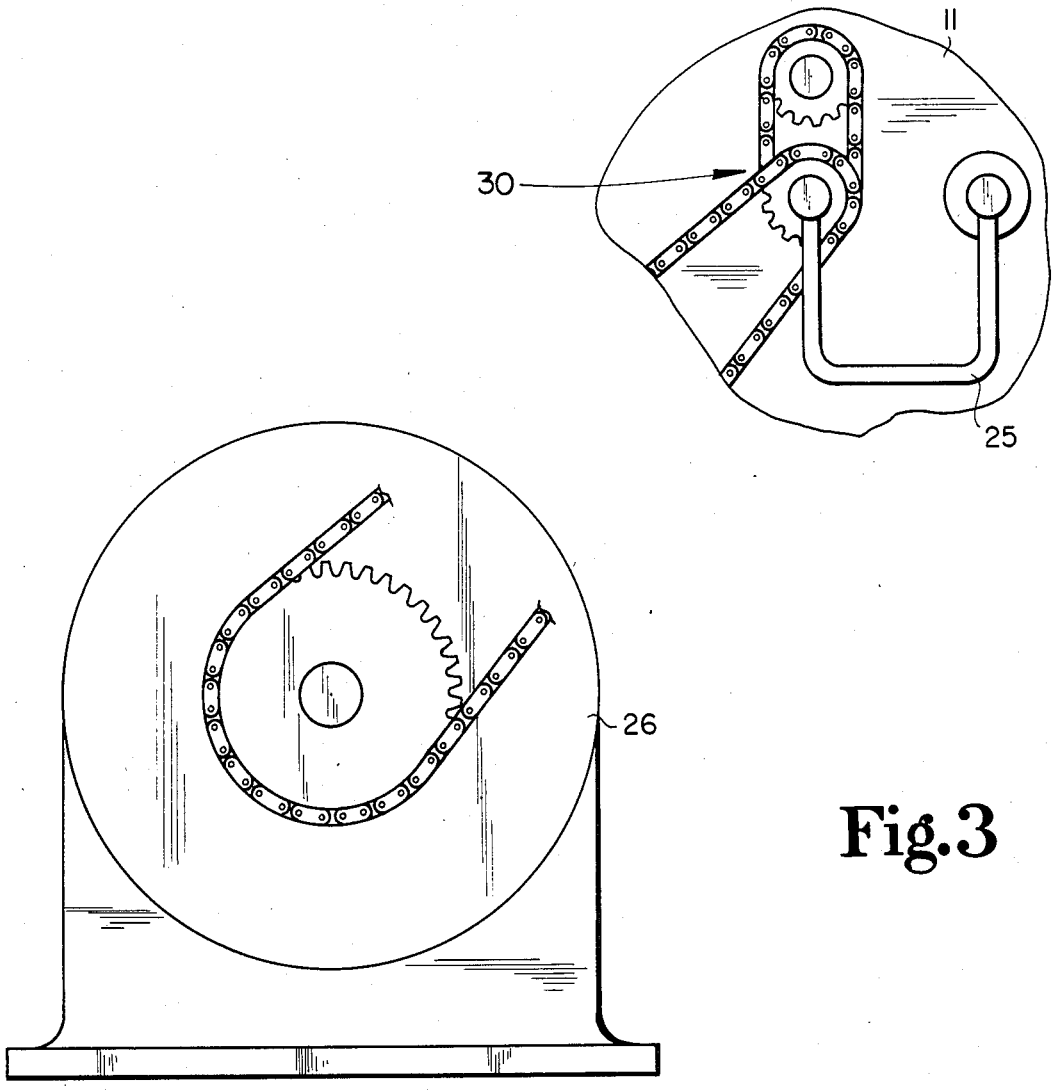
FIG. 3 is a fragmentary view showing the means for driving the one of the screw augers and associated scraper device.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the furnace 10 has a cylindrical shape defined by side and top refractory walls 11 and 12, respectively, defining a chamber 13 in which particulate material is heated on a turntable hearth 18. At the top of furnace 10, a feed inlet 14 communicates through wall 12 with chamber 13 for feeding particulate matter into the chamber. The particulate matter is continuously fed into chamber 13 at a desired uniform rate through rotary valve **14*a*. A burner 16 communicates heat into the chamber through an inlet in wall 11 and is exhausted through exhaust outlet 15. A discharge outlet 17 is provided in the bottom of chamber 13 for discharging the particulate material outside the chamber 13** after heating.

Turntable hearth 18 is rotatably disposed at the bottom of chamber 13 and rotates on the center axis of a vertically disposed drive shaft 19 which is aligned directly below the feed inlet 14. Drive shaft 19 is driven by a variable speed motor 20 mounted below hearth 18. Trunnion 21 provides a rolling support for the outer portions of hearth 18.

A pair of screw augers 24 having opposing half pitches are rotatably mounted horizontally in chamber 13 above hearth 18. Each screw auger 24 is water-cooled through an inner longitudinal cavity extending along the respective axis of rotation. The cavities are connected externally of the chamber 13 by a conduit 25 to provide a single continuous flow path for water circulated through the screw augers 24. The augers 24 are independently driven by separate drive motors 26.

Associated with each screw auger is a scraper 27 for cleaning the screw flights of particulate material which tends to gradually build up as the augers agitate, mix and convey the material deposited on hearth 18 radially outwardly from the axis of rotation of hearth 18 to off the periphery of the hearth. Each scraper 27 includes a hollow water-cooled shaft 28 rotatably mounted at opposite ends of wall 11 and a plurality of spikes or teeth 29 corresponding to the number of screw flights in the associated auger 24. The spikes 29 are spaced apart along the length of and fixedly secured to the shaft 28. Each scraper is drivably connected to and rotates in synchrony with the associated screw auger 24 through a chain and sprocket linkage 30 driven by a common drive motor 26.

Drive motor 20 and drive motors 26 include variable speed control means for variably controlling the rotational speed of the respective screw augers and hearth independently of one another.

A plurality of scraper blades 31 are fixedly secured at angularly spaced apart positions on the underside of hearth 18 at the periphery thereof and serve to transport material deposited into annular channel 32 from hearth 18 to discharge outlet 17 in the bottom of channel 32. A screw conveyor 35 conveys the particulate material from discharge outlet 17 to a storage tank located externally of furnace 10. For the production of litharge, screw conveyor 35 is preferably water-cooled to permit the temperature of the litharge to be quickly lowered below the temperature range where red lead formation occurs.

The operation of the furnace, as for example in the production of litharge in particulate form, may be generally described as follows. Lead or "leady oxide" (PbO+Pb) in particulate form is introduced into chamber 13 at a desired rate through rotary valve 14*a*. As the input material is deposited on the center of the turntable hearth, it is rotated on the hearth at a desired speed. Inside chamber 13, the material is heated to a temperature in the range of 650–1200 degrees F. depending upon the degree of product oxidation desired. While the material is being rotated on the hearth, screw augers 24 mix, tumble and distribute the material radially outwardly to the periphery of the hearth.

Since the screw augers 24 are of opposite pitch, one of the screw augers is used to convey the material radially outwardly towards the periphery of the hearth while the other of the screw augers, approximately 180 degrees angularly spaced apart therefrom, serves to convey the material radially inwardly toward the center axis of the hearth. In operation, the screw auger conveying the material inwardly rotates at a slower speed than the other screw auger so that the net result is radially outward movement of the material. By varying the speeds of the respective augers and the rotational speed of the turntable hearth, the amount of agitation and mixing of the particulate material can be easily variably controlled, as well as the length of time the material is subjected to heat inside the furnace.

From the edge of the hearth, the material gravitates into channel 32 where scraper blades 31 move the material into discharge outlet 17 for transportation by screw conveyor 35 to an externally located storage tank.

It may be noted that the furnace of the present invention allows for the production of particulate material, such as litharge, on a continuous as opposed to a batch basis, which eliminates down time and permits substantially higher production rates than batch method techniques.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A furnace for heating particulate material comprising:

top and side refractory walls defining a furnace chamber, at least one of said refractory walls defining a feed inlet for feeding particulate matter into said chamber, a discharge outlet for discharging said particulate material outside said chamber, and a burner inlet communicating inside said chamber:

heating means associated with said burner inlet for heating said particulate matter within said chamber:

a turntable hearth rotatably driving said hearth:

a distributing means, including at least one screw auger rotatably disposed above said turntable hearth, for mixing and conveying the contents of said chamber in a radial direction relative to said first axis of rotation of said turntable hearth by screw movement simultaneously with the rotation of said particulate material on said turntable hearth about said first axis of rotation, said distributing means including first and second screw augers angularly spaced apart relative to the first axis of rotation of said turntable hearth, said second screw auger having an opposite pitch from said first screw auger;

a second drive means connected to said screw auger for rotatably driving said screw auger in said chamber; and a third drive means connected to said second screw auger for rotatably driving said second screw auger at a slower speed than said first screw auger, said first and second screw augers distributing said particulate material in opposite radial directions relative to the center of said turntable hearth.

2. The furnace of claim 1 and further comprising:

a means, including first and second scrapers respectively associated with said first and second screw auger to rotate in synchrony therewith, for cleaning the screw flights of said first and second screw augers of particulate material thereon as said particulate material is distributed on said turntable hearth by said screw augers.

3. The furnace of claim 2 wherein each of said scrapers includes a plurality of teeth positioned to rotate in registry with the screw flights on said screw augers.

4. The furnace of claim 3 wherein said first and second screw augers rotate along parallel axes of rotation.

5. The furnace of claim 4 wherein said first and second screw augers are water cooled.

6. The furnace of claim 5 and further comprising:

a first control means for variably controlling the rotational speed of said turntable hearth on said first axis of rotation.

7. The furnace of claim 6 and further comprising:

a second and third control means for variably controlling the rotational speed of said first and second screw augers independently of one another and of the rotational speed of said turntable hearth.

* * * * *